US010567863B2

(12) United States Patent
Rauschmayer

(10) Patent No.: US 10,567,863 B2
(45) Date of Patent: Feb. 18, 2020

(54) SYSTEM AND METHOD FOR CONFIGURING AUDIO SIGNALS TO COMPENSATE FOR ACOUSTIC CHANGES OF THE EAR

(71) Applicant: RevX Technologies, Inc., Austin, TX (US)

(72) Inventor: Dennis Rauschmayer, Plano, TX (US)

(73) Assignee: RevX Technologies, Inc., Austin, TX (US)

( * ) Notice: Subject to any disclaimer, the term of this patent is extended or adjusted under 35 U.S.C. 154(b) by 0 days.

(21) Appl. No.: 16/117,132

(22) Filed: Aug. 30, 2018

(65) Prior Publication Data

US 2019/0191236 A1 Jun. 20, 2019

Related U.S. Application Data

(60) Provisional application No. 62/607,704, filed on Dec. 19, 2017.

(51) Int. Cl.

| | |
|---|---|
| ***H04R 1/10*** | (2006.01) |
| ***H04R 25/00*** | (2006.01) |
| ***G10K 11/178*** | (2006.01) |
| ***H04R 3/04*** | (2006.01) |
| ***H04R 29/00*** | (2006.01) |

(52) U.S. Cl.

CPC ..... *H04R 1/1041* (2013.01); *G10K 11/17813* (2018.01); *G10K 11/17823* (2018.01); *G10K 11/17881* (2018.01); *H04R 1/1083* (2013.01); *H04R 3/04* (2013.01); *H04R 29/001* (2013.01); *G10K 2210/1081* (2013.01); *G10K 2210/3035* (2013.01); *G10K 2210/3044* (2013.01); *G10K 2210/3046* (2013.01); *G10K 2210/3055* (2013.01); *H04R 1/1016* (2013.01); *H04R 2410/05* (2013.01); *H04R 2460/01* (2013.01); *H04R 2460/15* (2013.01)

(58) Field of Classification Search

CPC .. H04R 25/30; H04R 2225/025; H04R 25/70; A61B 5/6817

USPC ..... 381/312, 328, 74

See application file for complete search history.

(56) References Cited

U.S. PATENT DOCUMENTS

2014/0161267 A1* 6/2014 Saltykov ..... H04R 25/70 381/60

* cited by examiner

*Primary Examiner* — George C Monikang
(74) *Attorney, Agent, or Firm* — Lee & Hayes, P.C.

(57) ABSTRACT

Personal speaker systems including headset and earbud systems may be configured to capture audio data using an in-ear microphone while a speaker outputs known audio signals into the ear canal. The system may generate an acoustic model of the compressed ear canal and ear drum of the listener and utilize the acoustic model to provide noise cancellation at the eardrum, modification to the audio to result in a more natural sound at the eardrum, and/or to measure leakage of the personal speaker system.

20 Claims, 11 Drawing Sheets

100

SYSTEM AND METHOD FOR CONFIGURING AUDIO SIGNALS TO COMPENSATE FOR ACOUSTIC CHANGES OF THE EAR

This application claims priority to Provisional Application No. 62/607,704 filed on Dec. 19, 2017 and entitled "System for Configuring Audio Signals to Compensate for Acoustic Changes of the Ear," the entirety of which is incorporated herein by reference.

BACKGROUND

Typically, when a binaural sound recording is produced great care is exercised to accurately capture a location or direction of each of the instruments and vocals in the binaural recording. In some cases, the recording may also be captured in a manner to compensate for disturbances or modification to the sound caused by a listener's body and head. However, when an earbud is placed within an ear or a headset is placed over the ear, the earbud or headset causes a modification to or compression of the ear canal which is not compensated for when the audio is recorded.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
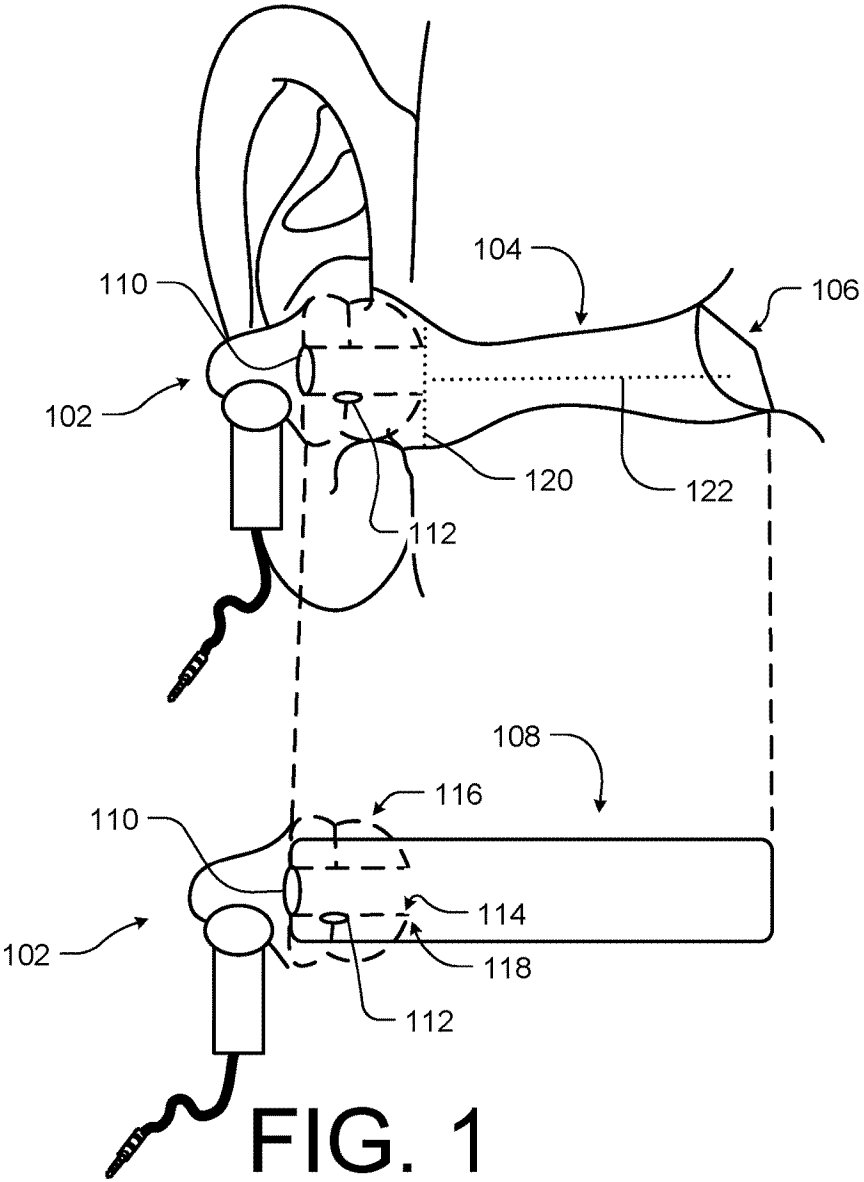
FIG. 1 illustrates an example having a personal speaker system inserted into an ear canal according to some implementations.

This disclosure includes techniques and implementation to measure and map an individual's ear canal and the acoustic response of the ear canal when excited by a personal speaker system. In some cases, the measurements may be used to allow a personal speaker system (such as an earbud or headset device) to modify an output audio signal to compensate for changes imposed on the audio as it travels from the personal speaker system to the individual's drum compared to if the individual listened to the same audio occurring in free space without the personal speaker system. For example, the personal speaker system my change the frequency characteristics of the audio and, thereby, make audio output different from the characteristics of the recording. In another example, the tip of the earbud is typically inserted into the ear canal, thereby, shorting the distance the sound travels within the ear prior to impacting the eardrum which changes the frequency characteristics of the sound. The changes to the audio characteristics caused by use of the personal speaker system result in a human detectable change to the sound that the user may perceive as unnatural.

Today, when a sound recording is produced great care is exercised to accurately capture a location or direction of each of the instruments and vocals to generate the most natural hearing experience possible for a listener. For instance, a binaural audio recording may be produced using two microphones that are separated by the approximate distance between a human's ears. Thus, the recording from the microphone on the right is played into the listener's right ear and the recording from the microphone on the left is played into the listeners left ear with the intention that the listener hears the audio as if he or she were present during the recording. In some cases, the audio recording may be recorded in a manner to also compensate for modifications caused by interface by a listener's body and head. For example, the right and left microphones used to record the audio signal may be mounted on a model that is representative of an average user. Therefore, the audio captured by the right and left microphones has undergone interface by at least an average human body and head.

Further, with the advancements in virtual visual environments, the desires to reproduce a 'live' experience as accurately as possible has been enhanced. For instance, the user may be immersed in a three-dimensional (3D) virtual scene representative of the environment in which the visual and audio data is captured. Thus, the user may experience both the visual and audio experience as if the user was present at the time and location the scene was captured. In these cases, great care may also be taken to capture audio in a manner in which the user is able to move through the virtual scene with both visual and audio stimulus changing as if the user moved through a real-life environment. For instance, the audio may be recorded from a plurality of positions within an environment, each of which compensates for the head and body interface. However, failure to compensate for the modification to an ear canal due to user of the personal speaker system may undermine the great care taken to reproduce the visual and audio scene and, thus, ruin the virtual experience being enjoyed by the user.

The system and methods discussed herein, allow for the personal speaker system (e.g., the earbud or headset) to measure, model, and map the listener's ear canal in a manner that allows the personal speaker system to modify the audio being output as sound to compensate for the modifications being introduced by the user of such personal speaker system. In this way, the sound captured by the listener's eardrum is received as if the user listening in a more natural setting devoid of the earbud or headset.

In some example, the system and method discussed herein may include a personal speaker system (such as an earbud or headset) configured to provided binaural audio output to a user. For example, the personal speaker system may be configured with speaker and an in-ear-microphone. The in-ear-microphone may be located within the ear canal or at a location closer to the eardrum than the speaker. The system may first determine a first thevinin equivalent pressure (Pth) and a first thevinin equivalent acoustic impedance (Zth) of the speaker system using the data captured by the in-ear-microphone.

The system may then model the distance between the position of the in-ear-microphone and the inner tip of the earbud as a first acoustic transmission line. For instance, the system may determine a first impedance ($Zo_1$), a first attenuation constant ($\alpha_1$), and a first phase constant ($\beta_1$) associated with the first acoustic transmission line (e.g., the distance between the in-ear-microphone and the inner tip of the earbud). Next the system may model the abrupt diameter change from the outer tip of the earbud and the diameter of the ear canal as a lumped inductance (Ldis) dependent on the ratio of the bud radius and the ear canal radius.

In some examples, the first thevinin equivalent pressure and the first thevinin equivalent acoustic impedance of the speaker system may be determined prior to assertion into the ear of the listener or known at the time of insertion.

The system may then model the length of the ear canal (e.g., the distance between the outer tip of the earbud and the eardrum) as a second acoustic transmission line. In this case, the system may determine a second impedance ($Zo_2$), a second attenuation constant ($\alpha_2$), and a second phase constant ($\beta_2$) associated with the second acoustic transmission line. Next the eardrum may be modeled as a complex lumped acoustic impedance (Zdrum).

When the thevinin equivalent pressure and thevinin equivalent acoustic impedance of the speaker system are known, the first impedance, the first attenuation constant, the first phase constant, the lumped inductance, the second impedance, the second attenuation constant, the second phase constant, and the complex lumped acoustic impedance may be determined by the system by outputting known sound into the ear canal and capturing audio signals using an in-ear microphone. The captured audio may then be analyzed to estimate the values above. In some cases, the known audio may be a wideband signal including wideband noise or a chirp signal. In some cases, the audio recording itself me be used as the known audio.

Once the system is able to model the ear canal using the thevinin equivalent pressure and thevinin equivalent acoustic impedance of the speaker, the characteristics of the first acoustic line (e.g., the distance between the speaker and the inner tip of the earbud), the lumped inductance associated with the transition between the outer tip of the earbud and the diameter of the ear canal, the characteristics of the second acoustic line (e.g., the distance between the outer tip of the are bud and the eardrum), and the complex lumped acoustic impedance, the system may utilize the model to provide noise cancellation or modify the audio signals to sound more natural at a various locations within the ear canal including at the ear drum. The system may also utilize the modeled ear canal values to monitor, determine, or compensate for acoustic leakage between the ear and the earbud.

For instance, in one example, the system may determine the acoustic sound pressure at a particular location, such as the eardrum. Then, the system, may determine acoustic sound pressure, the thevinin equivalent pressure and the thevinin equivalent acoustic impedance of the personal speaker system and the determined characteristics of the ear canal to perform noise cancellation at the ear drum and/or to modify an output audio signal to sound more natural (e.g., more like sound heard naturally without the listener engaged with a headsets or earbuds). Since the listener's ear canal and ear drum, along with their responses to the personal speaker are determined per listener the audio adjustments applied by the system are specific for each individual listener.

In one example, the system may determine the thevinin equivalent pressure at the eardrum (Pdrum) and the thevinin equivalent acoustic impedance of the eardrum (Zdrum) in order to perform, for instance, noise cancellation at the eardrum. In this example, the system may first measure a pressure ($P_{mic}$) associated with the point of the in-ear microphone. The system may then determine an equivalent acoustic impedance (Zin) looking into the ear from the point associated with the in-ear microphone. For example, the system may determine the equivalent acoustic impedance (Zin) at the in-ear microphone using the measured equivalent pressure ($P_{mic}$), the first thevinin equivalent pressure (Pth), and the first thevinin equivalent acoustic impedance (Zth) using the following equation:

$$Zin = \frac{Zth * P_{mic}}{Pth - P_{mic}}$$

Once the equivalent acoustic impedance (Zin) is determined the system may, the equivalent acoustic impedance associated with the inner tip of the earbud (Zinside). For example, the system may determine Zinside as follows:

$$Zinside = \frac{Zin - Zo_1 * \tanh(\gamma * L)}{Zo_1 - Zin * \tanh(\gamma * L)}$$

where L is the distance from the in-ear microphone to the inner tip of the earbud and $\gamma=\alpha_1+j\beta_1$, and j denotes the square root of negative one and $Zo_1$ represents the characteristic acoustic impedance of the acoustic line. The system also determines the equivalent pressure at the inner tip (Pinside) as follows:

$$Pinside = (1 + R_1)\frac{P_{mic}}{\exp(\gamma * L) + R * \exp(-\gamma * L)},$$

$$R_1 = \frac{Zinside - Zo_1}{Zinside + Zo_1}$$

Once the equivalent pressure at the inner tip (Pinside) and the equivalent acoustic impedance associated with the inner tip of the earbud (Zinside) are determined, the system may determine the equivalent pressure at the outer tip (Poutside) and the equivalent acoustic impedance associated with the outer tip of the earbud (Zoutside) as follows:

$$Zoutside = Zinside - j * \omega * Ldis$$

-continued $$Poutside = Pinside * \frac{Zoutside}{(j * \omega * Ldis) + Zoutside},$$

where ω=2πf and f is the frequency of the audio signal and j denotes the square root of negative one and Ldis is the discontinuity inductance associated with the diameter change between the ear bud radius and the ear canal radius.

Next the system determines based on the impedance looking into the ear from the outer tip the magnitude representing the half wavelength point of the ear canal. For example, the system may identify the first maximum of the impedance magnitude in the 4 kHz-10 kHz range and estimate the length of the ear canal, e.g. the distance between the outer tip and the eardrum, (Lcanal) as $$Lcanal = \frac{cAir}{2 * f_{max}}$$

where $f_{max}$ is the frequency at the maximum point and cAir is the speed of sound in air. In some cases, the radius of the ear canal may also be desirable. In these cases, the system may determine the radius of the ear canal as follows:

$$\text{Radius} = \sqrt[2]{\cot\left(\frac{2 * \pi * f * Lcanal}{cAir}\right) * rhoAir * \frac{cAir}{\pi * \text{abs}(ZVector)}}$$

where cAir is the speed of sound in air, rhoAir is the density of air and ZVector is the impedance of the ear canal at the frequency (f). In some examples, the radius may be determined using a plurality of frequencies and then the results may be average to generate an average radius of the listener's ear canal. In some instances, the radius determined may be greater than a maximum threshold (e.g., greater than a radius that is physically possible given human anatomy) or less than a minimum threshold (e.g., less than a radius that is physically possible given human anatomy). In these instances, the radius may be discarded or excluded from the radii used to generate the average radius.

In some specific examples, the radius of the ear canal and Lcanal are dependent on each other and, thus, the system may solve for each using an iterative process. For instance, the system may initialize the radius and Lcanal to standard or predetermined values. The system may then iterate solving for the radius and the Lcanal. After each iteration, the system may determine error values for the new radius and/or the Lcanal and adjust the value of the radius and the Lcanal based on the error values determined. The system may continue to update the radius and the Lcanal values until the error values are below an error threshold.

Once the length of the canal (Lcanal) is determines, the system may determine the equivalent pressure at the eardrum (Pdrum) and the equivalent acoustic impedance of the eardrum (Zdrum) as follows:

$$Zdrum = Zo_2 * \frac{Zoutside - Zo_2 * \tanh(\gamma * Lcanal)}{Zo_2 - Zoutside * \tanh(\gamma * Lcanal)}$$

$$Pdrum = (1 + R_2) * \frac{Poutside}{\exp(\gamma * Lcanal) + R_2 * \exp(-\gamma * Lcanal)}$$

-continued $$\text{where } R_2 = \frac{Zdrum - Zo_2}{Zdrum + Zo_2}$$

In some examples, in addition to the in-ear microphone, the system may include an external microphone (or a microphone on the exterior of the personal speaker system exposed to the environment). In one implementation, the system may utilize the external microphone to measure noise in the environment. The measured noise may be used to determine noise leakage into the ear canal from the exterior environment and/or to assist with noise cancellation. For example, the noise captured by the external microphone may be compared with noise captured by the internal microphone to determine leakage (e.g., noise present in the audio captured by both microphones). In some cases, the system may then add anti-noise to the output audio or signals that cause the leakage noise to be canceled. In the system discussed herein, the anti-noise may be configured to cancel the leakage noise at the eardrum rather than at the point of the in-ear microphone. Alternatively, the system discussed herein may cancel the leakage noise at the inner tip of the earbud or at the outer tip of the earbud.

In the various alternatives, the system may measure the noise energy at the external microphone (NEEM), measure the noise energy at the in-ear microphone (NEIM), estimate the noise energy at the desired point using the model of the listener's ear canal. The system may then use the estimated energy as an input to a noise cancellation algorithm or technique. In one specific example, the system may estimate the noise energy at the inner tip (NEIT) of the earbud. In this example, the system may determine the parallel combination (ZP) of the internal microphone impedance (ZMici) and the thevinin impedance (Zth) as follows:

$$ZP = \frac{ZMici * Zth}{Zmici + Zth}$$

Next, the system may determine the refection coefficient at the inner tip (RCIT) using the following equation:

$$RCIT = \frac{Zo_1 - ZP}{Zo_1 + ZP}$$

The noise energy at the inner tip (NEIT) may then be determined as follows:

$$NEIT = \frac{NEIM * (\exp(\gamma * Lbud) + RCIT * \exp(-\gamma * Lbud)}{1 + RCIT}$$

where Lbud is the length of the in-ear microphone to the inner tip of the earbud.

In another specific example, the system may estimate the noise energy at the outer tip (NEOT) of the earbud. In this example, the system may determine the noise energy at the inner tip (NEIT) as discussed above. Then the system may determine the impedance at the inner tip (Zbudin) as follows:

$$Zbudin = Zo_1 * \frac{ZMici + Zo_1 * \tanh(\gamma * Lbud)}{Zo_1 + Zmici * \tanh(\gamma * Lbud)}$$

Next, the system may determine the noise energy at the outer tip (NEOT) of the earbud using the following equation:

$$NEOT = NEIT * \frac{(j * \omega * Ldis) + Zbudin}{Zbudin}$$

where j denotes the square root of negative one, as discussed above.

In yet another specific example, the system may estimate the noise energy at the eardrum (NED) of the earbud. In this example, the system may determine the noise energy at the inner tip (NEIT) and the noise energy at the outer tip (NEOT) as discussed above. Then the system may determine the noise energy at the earbud (NED) using the following equation:

$$NED = (1 + RCIT) * \frac{NEIT}{\exp(\gamma * Lcanal) + RCIT * ex(-\gamma * Lcanal)}$$

In the above examples, the noise leakage estimations are used to cancel the noise at a point in the system. However, the system discussed herein may also determine the equivalent impedance of the noise leakage. For instance, the system may first determine the noise at the external microphone and the in-ear microphone. Next the system may determine the noise energy at the outer tip (NEOT) as discussed above. The system may then determine the impedance looking back towards the earbud from the outer tip of the earbud (ZCI) and the impedance looking toward the eardrum from the outer tip of the earbud (ZCD). Once, the impedances of ZCI and ZCD are estimated, the system may determine the parallel combination of ZCI and ZCD represented as Zin. In this example, the impedance of the leak (Zleak) may representative of the impedance leakage noise between the external environmental and the eardrum and determines as follows:

$$Zleak = (NE - NEOT) * \frac{Zin}{NEOT}$$

Where NE is representative of the noise energy at the exterior microphone.

In some cases, the noise leakage value determined may be used to quantify the quality of the fit of the earbud to the listener, suggest adjustments to the type of bud used by the listener or currently inserted into the ear, and adjusting parameters (such as the noise cancellation settings) to compensate for the leakage at the eardrum.

FIG. 1 illustrates an example 100 having of an acoustic model 108 of a personal speaker system 102 inserted into an ear canal 104 according to some implementations. In this example, the personal speaker system 102 (or earbud) may include a speaker 110 and an in-ear-microphone 112. Once the model 108 is generated, the model 108 may be used to measure noise leakage and/or provide noise cancellation at positions within the ear canal 104 such as at the eardrum 106, as discussed above and below.

In some cases, the acoustic model may include a first thevinin equivalent pressure (Pth) and a first thevinin equivalent acoustic impedance (Zth) of the speaker system 102 and a first acoustic transmission line representing the distance between the position of the in-ear-microphone 112 and the inner tip 114 of the earbud 116 of the personal speaker system 102 via a first characteristic impedance ($Zo_1$), a first attenuation constant ($\alpha_1$), and a first phase constant ($\beta_1$). The model 108 may also represent the abrupt diameter change from the outer tip 118 of the earbud 116 and the diameter 120 of the ear canal 104 as a lumped inductance (Ldis) dependent on the ratio of the bud radius and the ear canal radius. In the illustrated example, the diameter 120 of the ear canal 104 may be modeled as a constant. The model 108 may also represent the length 122 of the ear canal 104 (e.g., the distance between the outer tip 118 and the eardrum 106) as a second acoustic transmission line having a second characteristic impedance ($Zo_2$), a second attenuation constant ($\alpha_2$), and a second phase constant ($\beta_2$). Finally, the model 108 may represent the eardrum 106 as a complex lumped acoustic impedance (Zdrum).

Figure 2:
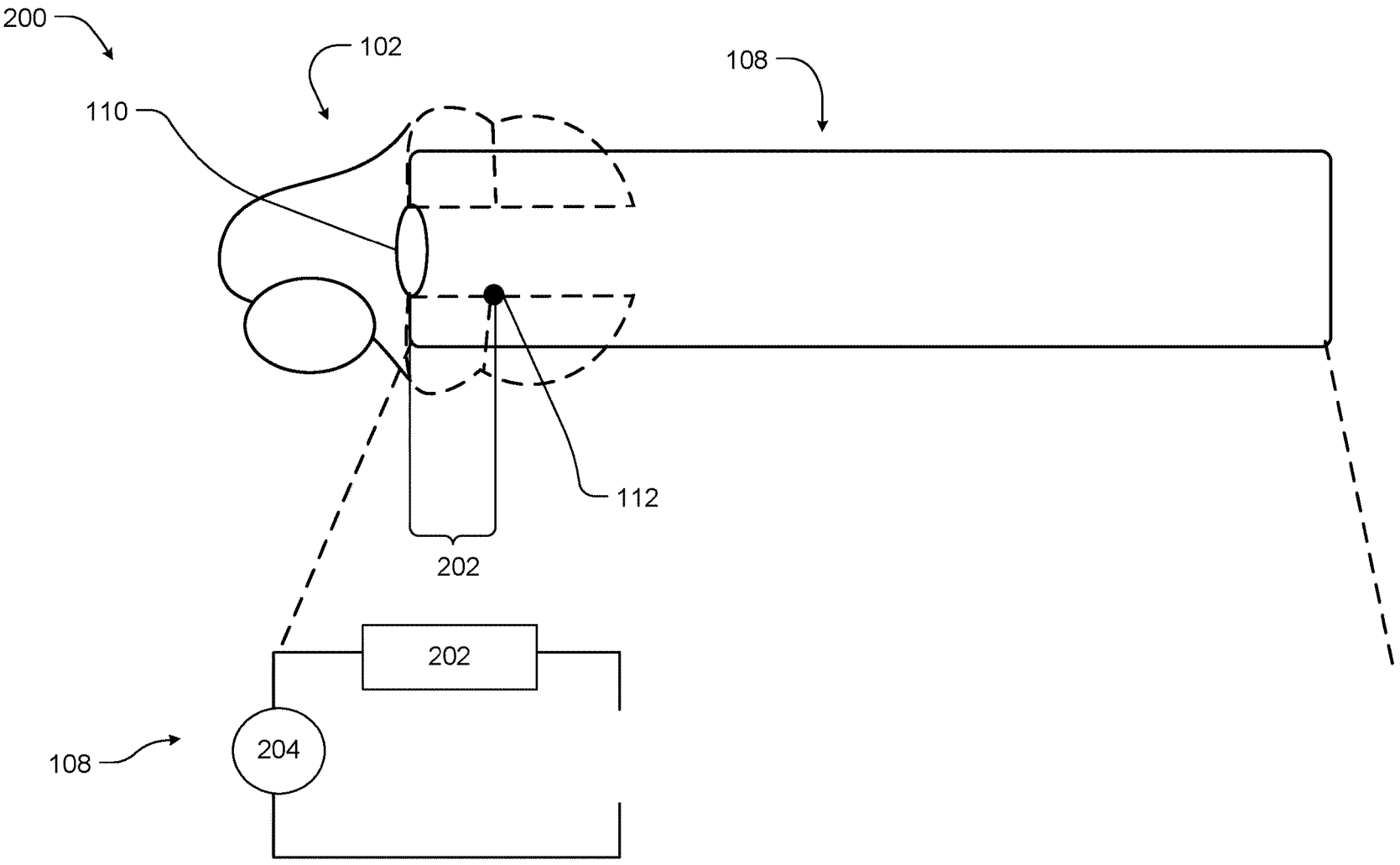
FIG. 2 illustrates an example of the model having a personal speaker system inserted into an ear canal according to some implementations.

FIG. 2 illustrates an example 200 of the model 108 having a personal speaker system 102 inserted into an ear canal (not shown) according to some implementations. In this example, the personal speaker system 102 has a speaker 110 and an in-ear-microphone 112. In this example, the model 108 may represent the personal speaker system 102 via a thevinin equivalent pressure (Pth) 204 and a thevinin equivalent acoustic impedance (Zth) 202 both of which may be measured in a lab using testing equipment and the personal speaker system 102.

The system may then determine a equivalent acoustic impedance (Zin) looking into the ear from the position of the in-ear-microphone 112. For example, the system may determine the equivalent acoustic impedance (Zin) at the in-ear microphone 102 using the first equivalent pressure (Pth) 204 and the first equivalent acoustic impedance (Zth) 202 using the following equation:

$$Zin = \frac{Zth * P_{mic}}{Pth - P_{mic}}$$

where $P_{mic}$ is the measured equivalent pressure at the in-ear-microphone 112.

Figure 3:
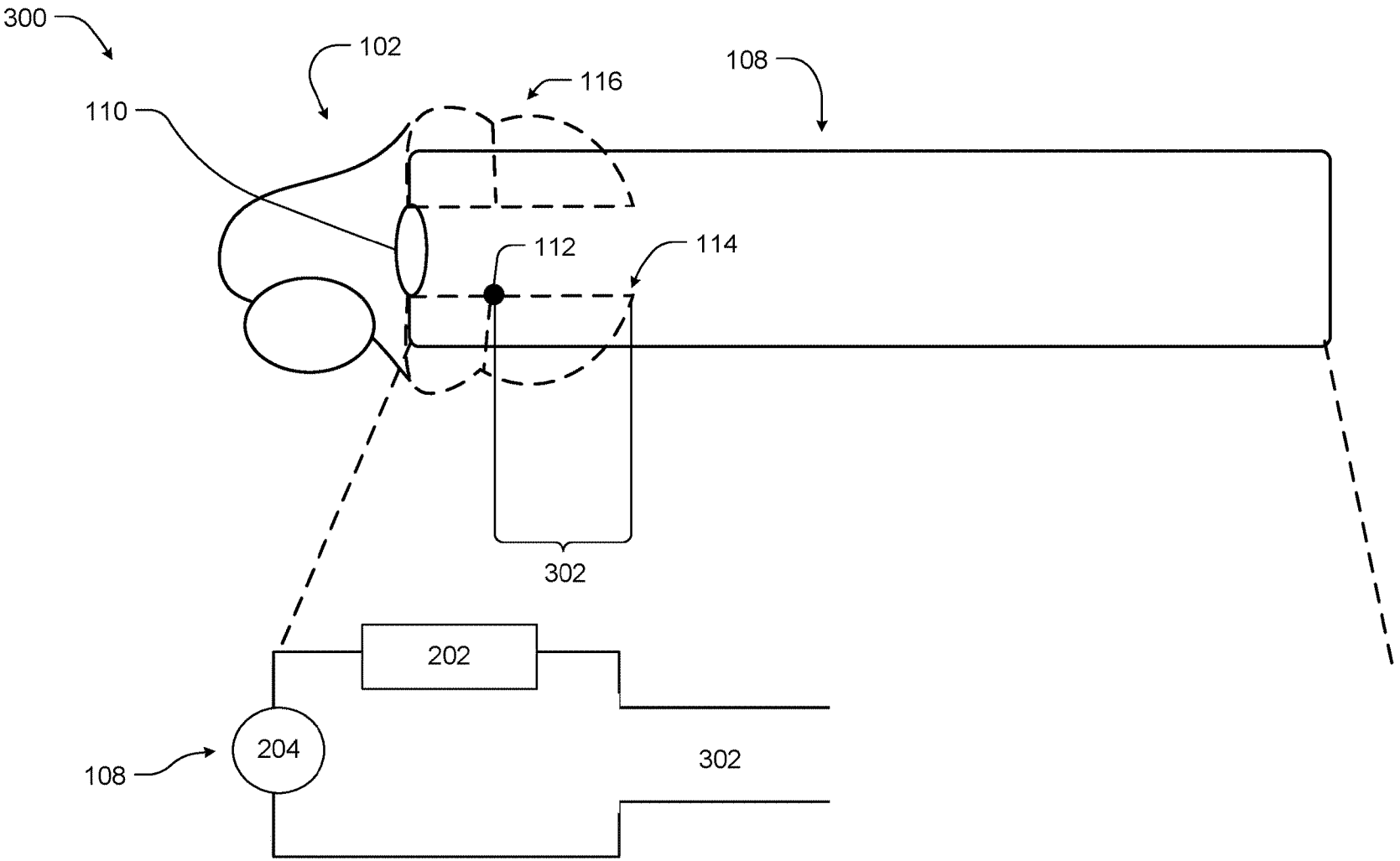
FIG. 3 illustrates an example of the model having a personal speaker system inserted into an ear canal according to some implementations.

FIG. 3 illustrates an example 300 of the model 108 having a personal speaker system 102 inserted into an ear canal (not shown) according to some implementations. In this example, the thevinin equivalent pressure (Pth) 204 and the thevinin equivalent acoustic impedance (Zth) 202 have been determined, for instance, by measuring the personal speaker system 102 in a lab. The model 108 may also represent the distance between the in-ear-microphone 112 and the inner tip 114 of the earbud 116 as an acoustical transmission line 302. For example, the acoustical transmission line may be represented using a first characteristic impedance ($Zo_1$), a first attenuation constant ($\alpha_1$), and a first phase constant ($\beta_1$).

In some cases, the first characteristic impedance ($Zo_1$), the first attenuation constant ($\alpha_1$), and the first phase constant ($\beta_1$) of the first transmission line 302 may be determined by knowing the physical characteristics of the earbud. Also in some cases, the acoustic pressure and acoustic impedance at the inner tip 114 may be determined by outputting known sound into the ear canal and capturing audio signals using the in-ear microphone 112. The captured audio may then be analyzed to estimate the values.

Figure 4:
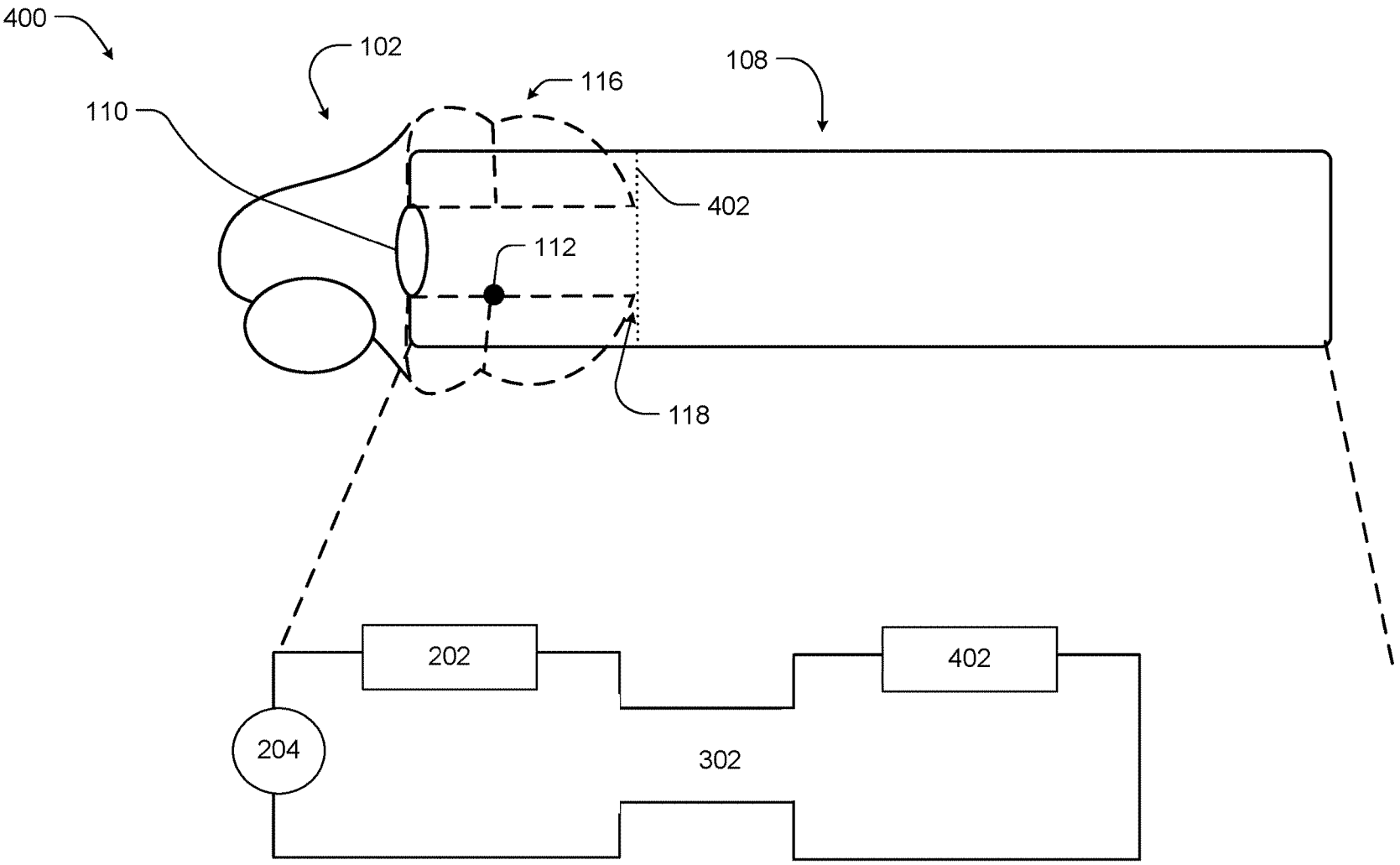
FIG. 4 illustrates an example of the model having a personal speaker system inserted into an ear canal according to some implementations.

FIG. 4 illustrates an example 400 of the model 118 having a personal speaker system 102 inserted into an ear canal (not shown) according to some implementations. In the current example, the abrupt diameter change from the outer tip 118 of the earbud 116 and the diameter of the ear canal as a lumped inductance (Ldis) 402 dependent on the ratio of the bud radius and the ear canal radius. Again, the lumped inductance (Ldis) 402 may be determined by outputting known sound into the ear canal, capturing audio signals using the in-ear microphone 112, and analyzing the captured audio to estimate the value.

Figure 5:
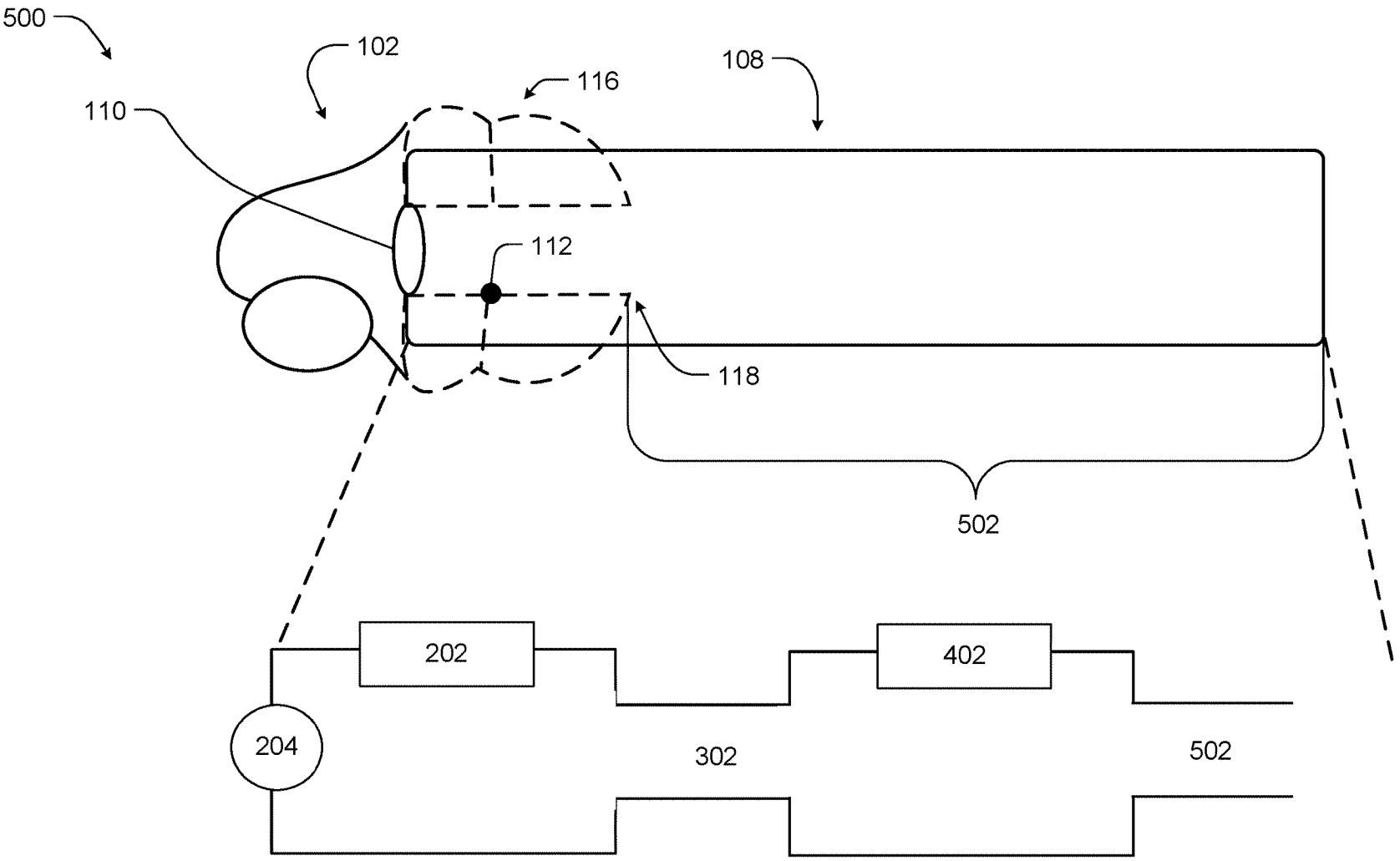
FIG. 5 illustrates an example of the model having a personal speaker system inserted into an ear canal according to some implementations.

FIG. 5 illustrates an example 500 of the model 108 having a personal speaker system 102 inserted into an ear canal (not shown) according to some implementations. In the current example, the length of the ear canal or the distance between the outer tip 118 of the earbud 116 and the eardrum (not shown) may be represented within the model 118 as a second acoustic transmission line 502. The second acoustic transmission line 502 may include a second impedance ($Zo_2$), a second attenuation constant ($\alpha_2$), and a second phase constant ($\beta_2$). Once again, the second impedance ($Zo_2$), the second attenuation constant ($\alpha_2$), and the second phase constant ($\beta_2$) may be determined by outputting known sound into the ear canal, capturing audio signals using the in-ear microphone 112, and analyzing the captured audio to estimate the value.

Figure 6:
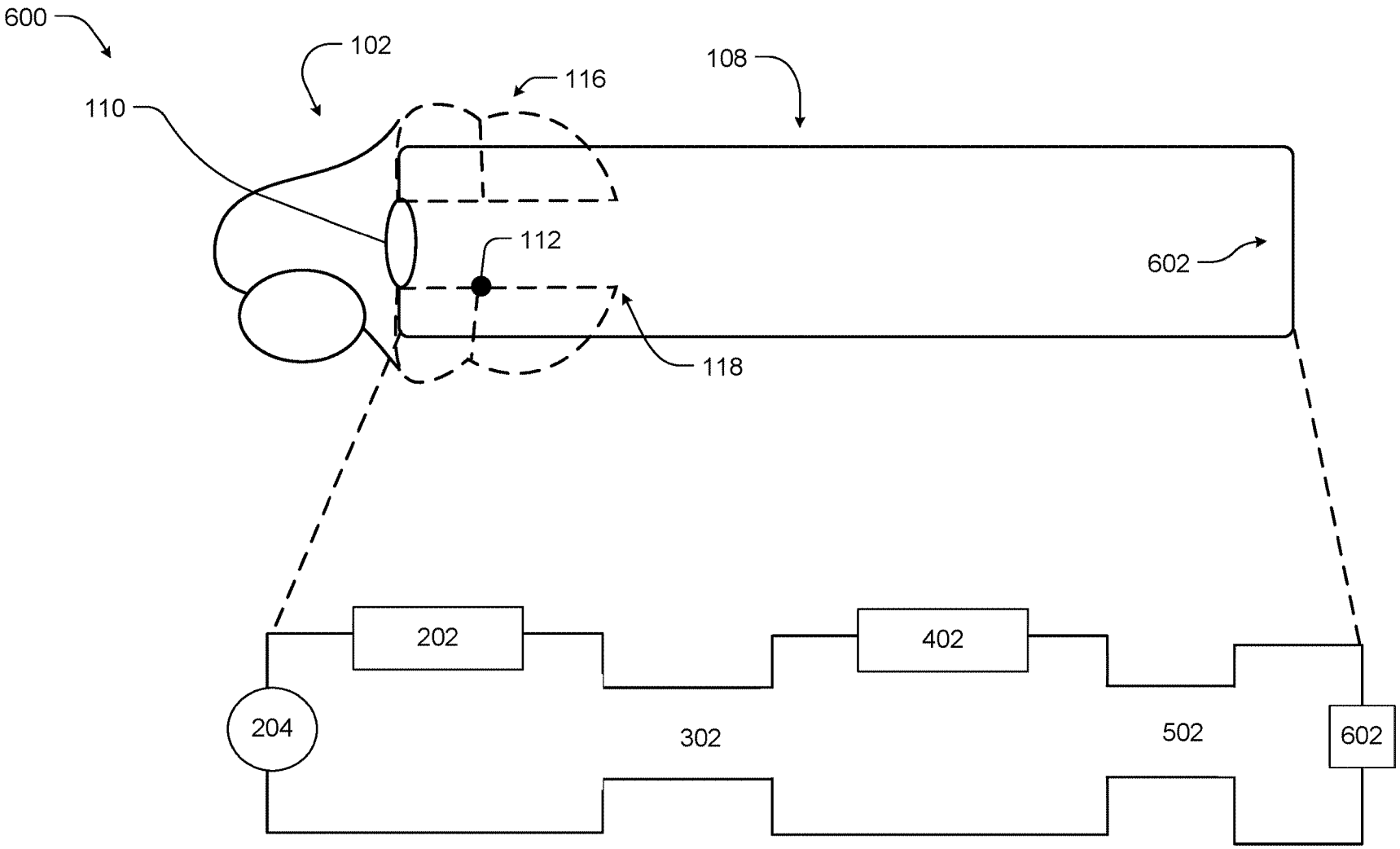
FIG. 6 illustrates an example of the model having a personal speaker system inserted into an ear canal according to some implementations.

FIG. 6 illustrates an example 600 of the model 108 having a personal speaker system 102 inserted into an ear canal (not shown) according to some implementations. In the current example, the eardrum may be modeled as a complex lumped acoustic impedance (Zdrum) 602. Again, the complex lumped acoustic impedance (Zdrum) 602 may be determined by outputting known sound into the ear canal, capturing audio signals using the in-ear microphone 112, and analyzing the captured audio to estimate the value.

FIGS. 7-10 are flow diagrams illustrating example processes associated with the acoustic model of FIGS. 1-6. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments.

Figure 7:
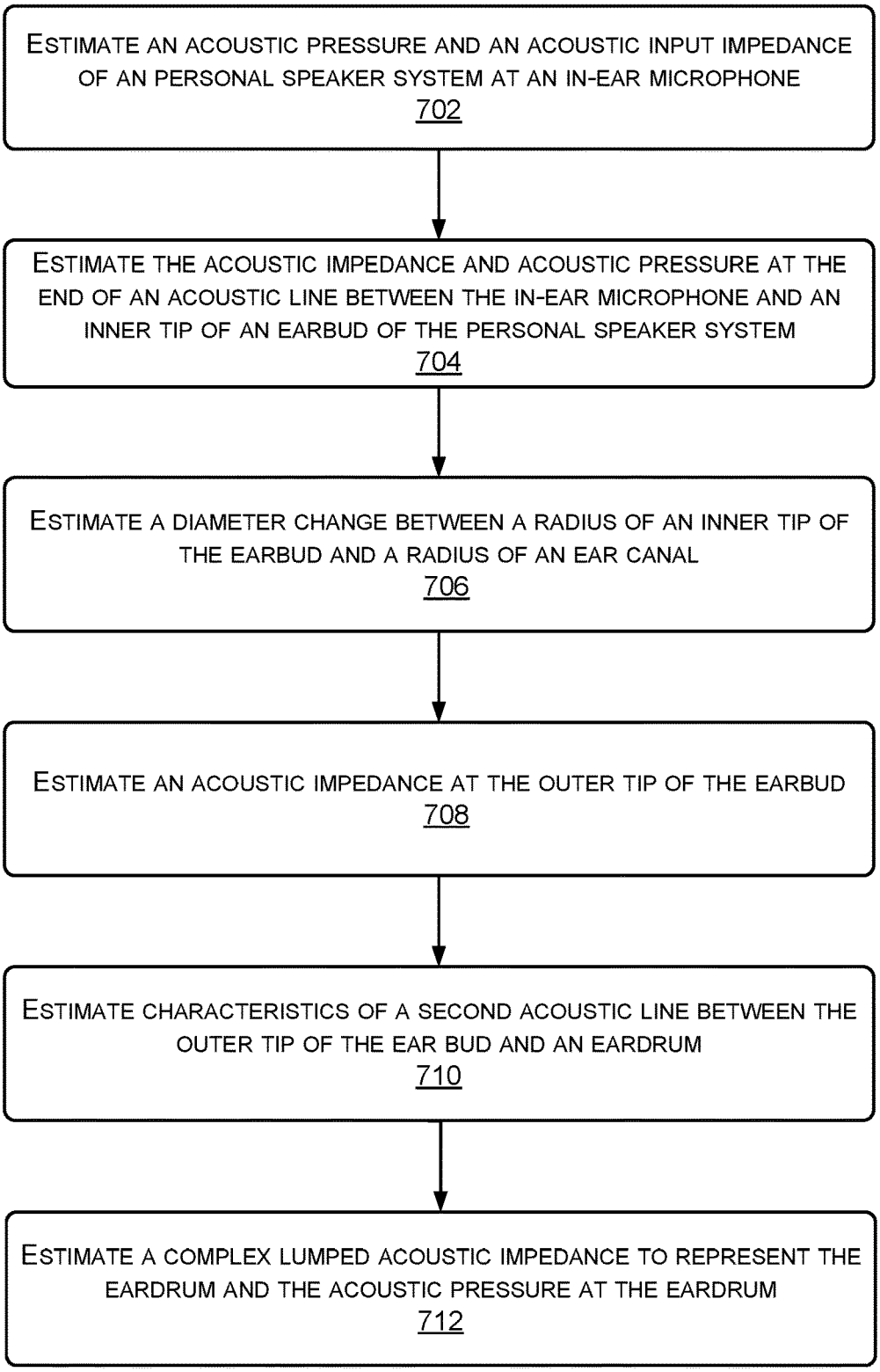
FIG. 7 is an example flow diagram showing an illustrative process for generating an acoustic model of an ear canal according to some implementations.

FIG. 7 is an example flow diagram showing an illustrative process 700 for generating an acoustic model of an ear canal according to some implementations. In the current example, the acoustic model may be representative of a particular listener's ear canal and generated via a particular personal speaking system inserted into or placed around the particular listener's ear. In this manner, the acoustic model may be custom for each individual listener and for each individual personal speaker system. Thus, if the same listener uses a second or different personal speaker system, the generated acoustic models may vary, as the compression experienced by the ear canal and the distance between the speakers, in-ear-microphones, and eardrum also vary.

The process 700 may being with 702, following the listener inserting the personal speaker system onto or into the listener's ear. At 702, the system may estimate an acoustic pressure and an acoustic input impedance of the personal speaker system at an in-ear-microphone. In some cases, a thevinin equivalent pressure (Pth) and a thevinin equivalent acoustic impedance (Zth) may be estimated in a lab and used in the estimation of the acoustic pressure and the acoustic input impedance.

At 704, the system may estimate the acoustic impedance and acoustic pressure at the end of a first acoustic line between the in-ear microphone and an inner tip of an earbud of the personal speaker system. For example, the acoustic impedance and acoustic pressure may be estimated by outputting by the speaker of the personal speaker system a known sound (such as wideband noise) and capturing reverberations. The characteristics of a first acoustic line between the in-ear microphone and an inner tip of an earbud of the personal speaker system. For example, the acoustical transmission line may be represented using a first impedance ($Zo_1$), a first attenuation constant ($\alpha_1$), and a first phase constant ($\beta_1$) each of which may be estimated by using information known about the physical dimensions of the earbud.

At 706, the system may estimate a diameter change between a radius of an inner tip of the earbud and a radius of the ear canal and, at 708, the system may estimate an acoustic impedance at the outer tip of the earbud. In some examples, the abrupt diameter change may be modeled using a lumped inductance (Ldis) dependent on the ratio of the earbud radius and the ear canal radius. Again, the lumped inductance (Ldis) may be determined by outputting known sound into the ear canal, capturing audio signals using the in-ear microphone, and analyzing the captured audio to estimate the value. In some examples, an estimate of the acoustic pressure and acoustic impedance at the outer tip may then be made.

At 710, the system may estimate characteristics of a second acoustic line outer tip of the earbud and the listener's eardrum. For example, the acoustical transmission line may be represented using a second impedance ($Zo_2$), a second attenuation constant ($\alpha_2$), and a second phase constant ($\beta_2$) each of which may be estimated by outputting by the speaker of the personal speaker system a known sound (such as wideband noise) and capturing reverberations.

At 712, the system may estimate a complex lumped acoustic impedance (Zdrum) to represent the eardrum and the acoustic pressure at the eardrum within the acoustic model and the resulting acoustic pressure at the eardrum. In some cases, the complex lumped acoustic impedance (Zdrum) and the acoustic pressure at the eardrum may be estimated by outputting known sound into the ear canal, capturing audio signals using the in-ear microphone, and analyzing the captured audio to estimate the value.

Figure 8:
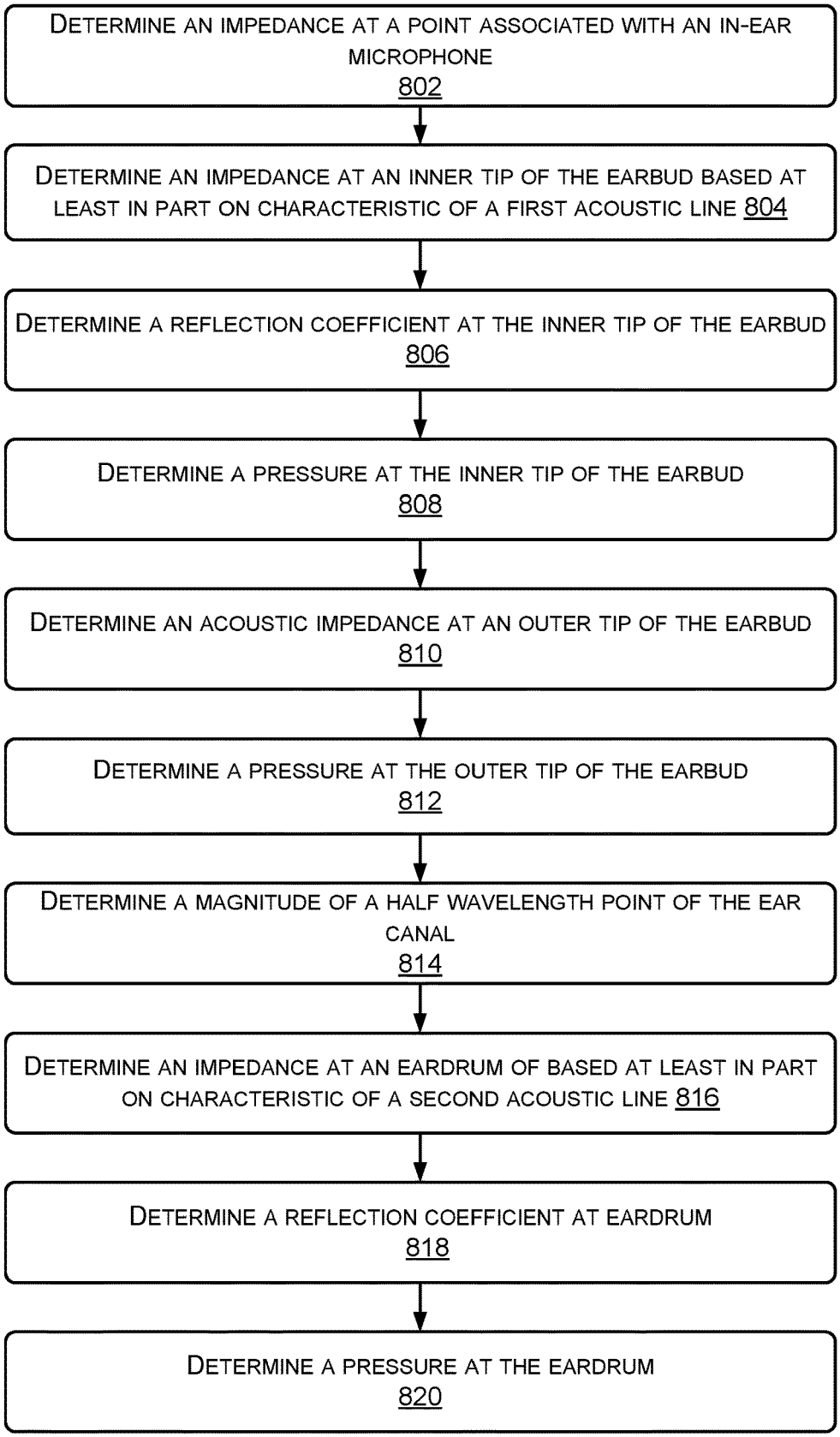
FIG. 8 is an example flow diagram showing an illustrative process for determining an acoustic pressure and a complex acoustic impedance at an eardrum of a listener according to some implementations.

FIG. 8 is an example flow diagram showing an illustrative process 800 for determining an acoustic pressure at an eardrum of a listener according to some implementations. For example, by determining the acoustic pressure at the eardrum, the system is able to provide noise cancellation at the eardrum and/or to determine acoustic modifications to the output sound to cause the sound to be heard in a more natural manner (e.g., without the user of a personal speaker system).

It should be understood, that the process 800 is performed using the acoustic model generated as discussed above with respect to FIGS. 1-7. Thus, once the acoustic model specific to an individual and current listener is generated, the acoustic model may be used to determine the acoustic pressure at the listener's eardrum.

At 802, the system may determine an impedance at a point associated with the in-ear microphone. In some cases, the system may first measure a pressure ($P_{mic}$) associated with the point of the in-ear microphone. The system may then determine an acoustic impedance (Zin) looking into the ear from the point associated with the in-ear microphone. For example, the system may determine the acoustic impedance (Zin) at the in-ear microphone using the measured pressure ($P_{mic}$), the first pressure (Pth), and the first thevinin equivalent acoustic impedance (Zth) associated with the acoustic model. In these cases, the acoustic impedance (Zin) may be calculated as follows:

$$Zin = \frac{Zth * P_{mic}}{Pth - P_{mic}}$$

At 804, the system may determine an impedance at an inner tip of the earbud of the personal speaker system (Zinside) based at least in part on characteristics of a first acoustic line. For instance, as discussed above the acoustic model may include a first impedance ($Zo_1$), a first attenuation constant ($\alpha_1$), and a first phase constant ($\beta_1$) associated with the first acoustic line (e.g., the distance between the in-ear microphone and the inner tip of the earbud).

Using the acoustic model and the acoustic impedance (Zin), the system may determine the acoustic impedance (Zinside) as follows:

$$Zinside = \frac{Zin - Zo_1 * \tanh(\gamma * L)}{Zo_1 - Zin * \tanh(\gamma * L)}$$

In the equations above, L is the distance from the in-ear microphone to the inner tip of the earbud and $\gamma=\alpha_1+j\beta_1$, and j denotes the square root of negative one.

At 806, the system may determine a reflection coefficient ($R_1$) at the inner tip of the earbud. For example, reflection coefficient ($R_1$) may be determined using:

$$R_1 = \frac{Zinside - Zo_1}{Zinside + Zo_1}$$

At 808, the system may determine a pressure at the inner tip (Pinside). For example, the pressure at the inner tip (Pinside) may be determined as follows:

$$Pinside = (1 + R_1)\frac{P_{mic}}{\exp(\gamma * L) + R_1 * \exp(-\gamma * L)},$$

At 810, the system may determine an acoustic impedance associated with the outer tip of the earbud (Zoutside). For example, the system may determine the acoustic impedance (Zoutside) as follows:

$$Zoutside = j*\omega*Ldis$$

where $\omega=2\pi f$, j denotes the square root of negative one, and Ldis is the lumped inductance of the abrupt change in diameter between the earbud and the ear canal from the acoustic model.

At 812, the system may determine a pressure at the outer tip (Poutside). For example, the system may determine the equivalent pressure at the outer tip (Poutside) as follows:

$$Poutside = Pinside * \frac{Zoutside}{(j * \omega * Ldis) + Zoutside}$$

where $\omega=2\pi f$, f is the frequency of the audio signal, and j again denotes the square root of negative one.

At 814, the system may determine a magnitude of a half wavelength point of the ear canal. For example, the system may identify the first maximum of the impedance magnitude in the 4 kHz-10 kHz range and compute the length of the ear canal, e.g. the distance between the outer tip and the eardrum, (Lcanal). In some cases, the distance may be determined as follows:

$$Lcanal = \frac{cAir}{2 * f_{max}}$$

where $f_{max}$ is the frequency at the maximum point and cAir is the speed of sound in air. In some cases, the radius of the ear canal may also be desirable. In these cases, the system may determine the radius of the ear canal as follows:

$$\text{Radius} = \sqrt[2]{\cot\left(\frac{2 * \pi * f * Lcanal}{cAir}\right) * rhoAir * \frac{cAir}{\pi * \text{abs}(ZVector)}}$$

where rhoAir is the density of air and ZVector is the impedance of the ear canal at the frequency (f). In some examples, the radius may be determined using a plurality of frequencies and then the results may be average to generate an average radius of the listener's ear canal. In some instances, the radius determined may be greater than a maximum threshold (e.g., greater than a radius that is physically possible given human anatomy) or less than a minimum threshold (e.g., less than a radius that is physically possible given human anatomy). In these instances, the radius may be discarded or excluded from the radii used to generate the average radius.

In some specific examples, the radius of the ear canal and Lcanal are dependent on each other and, thus, the system may solve for each using an iterative process. For instance, the system may initialize the radius and Lcanal to standard or predetermined values. The system may then iterate solving for the radius and the Lcanal. After each iteration, the system may determine error values for the new radius and/or the Lcanal and adjust the value of the radius and the Lcanal based on the error values determined. The system may continue to update the radius and the Lcanal values until the error values are below an error threshold.

At 816, the system may determine an acoustic impedance of the eardrum (Zdrum) as follows:

$$Zdrum = Zo_2 * \frac{Zoutside - Zo_2 * \tanh(\gamma * Lcancal)}{Zo_2 - Zoutside * \tanh(\gamma * Lcanal)}$$

where $\gamma=\alpha_1+j\beta_1$, and j denotes the square root of negative one. Thus, in this case, the system utilizes the characteristics of the second acoustic line representative of the ear canal of the user and the length of the ear canal.

At 818, the system may determine a reflection coefficient ($R_2$) at the eardrum. For example, the system may determine the reflection coefficient ($R_2$) using the following equation:

$$R_2 = \frac{Zdrum - Zo_2}{Zdrum + Zo_2}$$

At 820, the system may determine a pressure at the eardrum (Pdrum). In some cases, the pressure at the eardrum (Pdrum) may be determined using the following:

$$Pdrum = (1 + R_2) * \frac{Poutside}{\exp(\gamma * Lcanal) + R_2 * \exp(-\gamma * Lcanal)}$$

For instance, the pressure may be used to provided noise cancellation at the eardrum opposed to at the location of the in-ear microphone.

Figure 9:
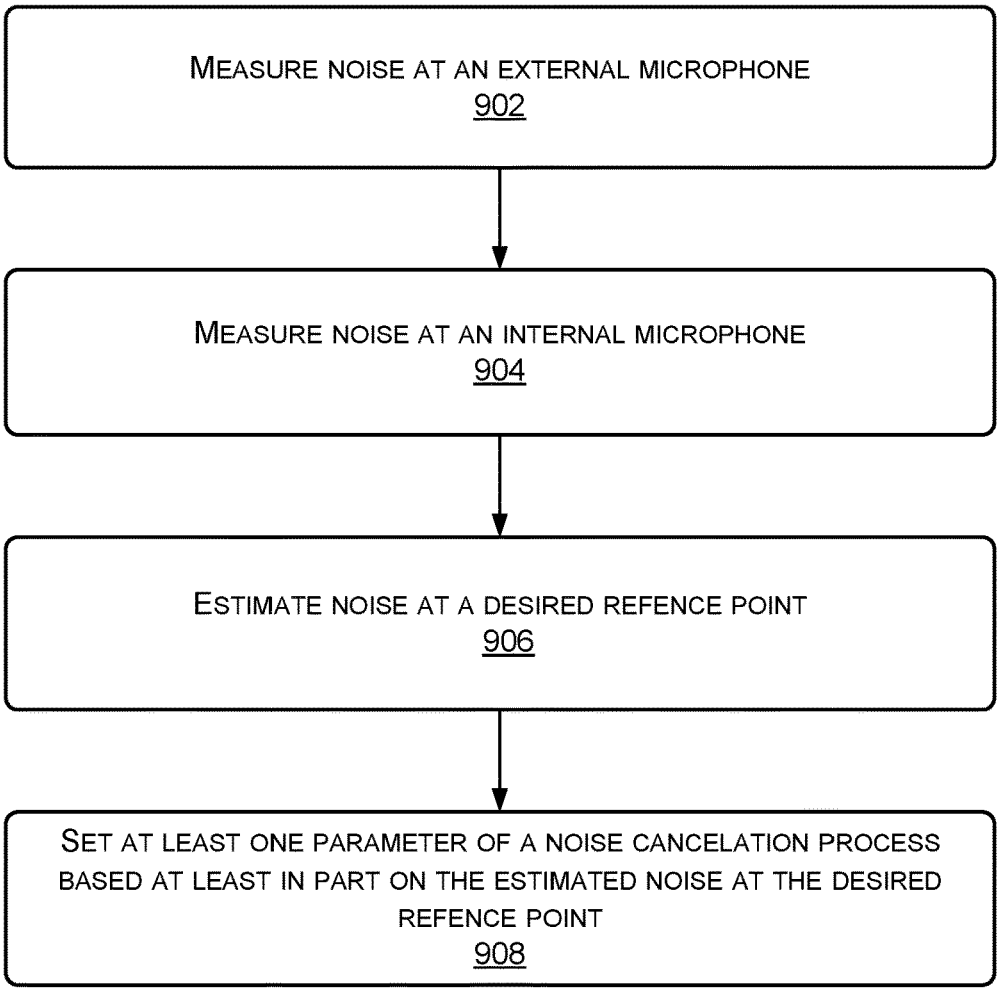
FIG. 9 is an example flow diagram showing an illustrative process for providing noise cancellation at the eardrum according to some implementations.

FIG. 9 is an example flow diagram showing an illustrative process 900 for providing noise cancellation at the eardrum according to some implementations. For instance, in some examples, the system may include an external microphone to measure noise in the environment. The measured noise may be used to determine noise leakage into the ear canal from the exterior environment and/or to assist with noise cancellation. For example, the noise captured by the external microphone may be compared with noise captured by the in-ear microphone to determine leakage (e.g., noise present in the audio captured by both microphones). In some cases, the system may then add anti-noise to the output audio or signals that cause the leakage noise to be canceled. In the current example, the anti-noise may be generated by a process that uses parameters representative of the sound at the eardrum to cancel the leakage noise at the eardrum rather than at the point of the in-ear microphone.

At 902, the system may measure the noise energy at the external microphone (NEEM) and, at 904, the system may also measure the noise energy at the in-ear microphone (NEIM).

At 906, the system may estimate the noise energy at the desired reference point using the model of the listener's ear canal. For instance, if the reference point is the eardrum, the system may determine the pressure at the eardrum (Pdrum) and the acoustic impedance of the eardrum (Zdrum) as discussed above with respect to FIG. 8.

At 908, the system may use the estimated noise energy (e.g., the pressure and the acoustic impedance at the reference point) to set at least one parameter of a noise cancellation process. For instance, the system may first estimate the noise energy at the inner tip (NETT) of the earbud. In this example, the system may determine the parallel combination (ZP) of the in-ear microphone impedance (ZMici) and the thevinin impedance (Zth) as follows:

$$ZP = \frac{Zmici * Zth}{Zmici + Zth}$$

Next, the system may determine the refection coefficient at the inner tip (RCIT) using the following equation:

$$RCIT = \frac{Zo_1 - ZP}{Zo_1 + ZP}$$

The noise energy at the inner tip (NEIT) may then be determined as follows:

$$NEIT = \frac{NEIM * (\exp(\gamma * Lbud) + RCIT * \exp(-\gamma * Lbud)}{1 + RCIT}$$

where Lbud is the length of the in-ear microphone to the inner tip of the earbud.

In another specific example, the system may estimate the noise energy at the outer tip (NEOT) of the earbud. In this example, the system may determine the noise energy at the inner tip (NEIT) as discussed above. Then the system may determine the impedance at the inner tip (Zbudin) as follows:

$$Zbudin = Zo_1 * \frac{ZMici + Zo_1 * \tanh(\gamma * Lbud)}{Zo_1 + ZP * \tanh(\gamma * Lbud)}$$

Next, the system may determine the estimated noise energy at the outer tip (NEOT) of the earbud using the following equation:

$$NEOT = NEIT * \frac{(j * \omega * Ldis) + Zbudin}{Zbudin}$$

where j denotes the square root of negative one, as discussed above.

Next, the system may estimate the noise energy at the eardrum (NED) of the earbud. In this example, the system may determine the noise energy at the inner tip (NEIT) and the noise energy at the outer tip (NEOT) as discussed above. Then the system may determine the noise energy at the earbud (NED) using the following equation:

$$NED = (1 + RCIT) * \frac{NEIT}{\exp(\gamma * Lcanal) + RCIT * ex(-\gamma * Lcanal)}$$

In the example process 900, the noise is canceled at the eardrum but in other implementations the noise may be canceled at other points, such as inside the earbud (e.g., at the inner tip (NEIT) or at the outer tip (NEOT)).

Figure 10:
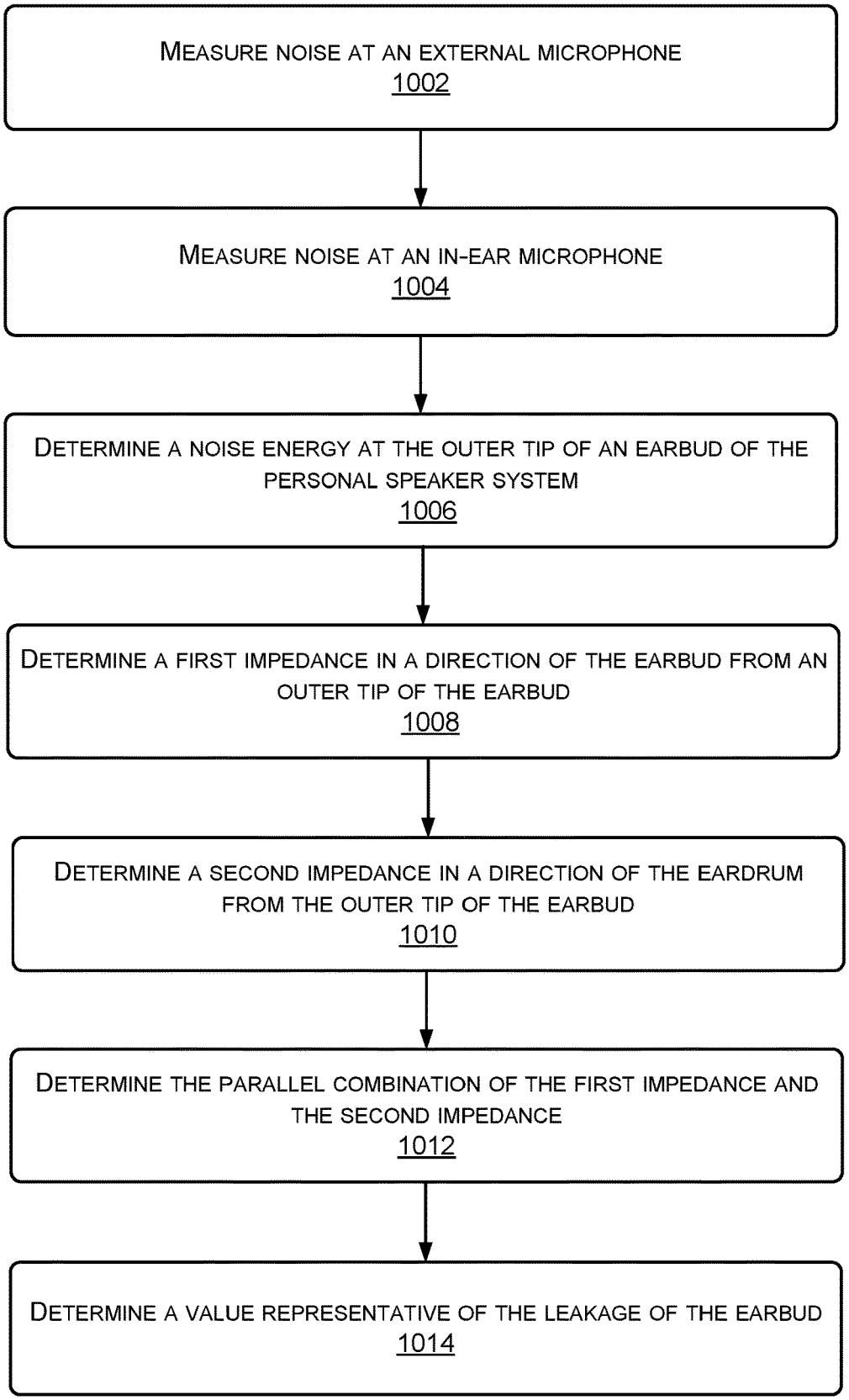
FIG. 10 is an example flow diagram showing an illustrative process for determining noise leakage at the eardrum according to some implementations.

FIG. 10 is an example flow diagram showing an illustrative process 1000 for determining noise leakage at the eardrum according to some implementations. In the example of FIG. 9, the noise leakage that is canceled is calculated at the in-ear microphone. However, the system discussed herein may also determine the noise leakage at the eardrum in addition to canceling the noise leakage at the eardrum.

At 1002, the system may first measure noise at the external microphone and, at 1004, the system may measure noise at an in-ear microphone.

At 1006, the system may determine the noise energy at the outer tip (NEOT). For example, as discussed above, the system may determine the estimated noise energy at the outer tip (NEOT) of the earbud using the following equation:

$$NEOT = NEIT * \frac{(j * \omega * Ldis) + Zbudin}{Zbudin}$$

where j denotes the square root of negative one, as discussed above. At 1008, the system may then determine a first impedance looking back towards the earbud from the outer tip of the earbud (ZCI). For example, the first thevinin impedance (ZCI) may be based on the thevinin acoustic pressure of the speaker driver, the thevinin acoustic impedance of the speaker driver, the characteristics of the acoustic line between the internal microphone and the inner tip and the radius discontinuity between the inner tip of the ear bud and the ear canal.

At 1010, the system may determine a second impedance looking toward the eardrum from the outer tip of the earbud (ZCD). Again, the second impedance (ZCD) may be based on characteristics of the acoustic line between the outer tip and the ear drum and on the ear drum acoustic impedance.

At 1012, the system may determine the parallel combination of ZCI and ZCD represented as Zin:

$$Zin = \frac{ZCI + ZCD}{ZCI * ZCD}$$

Once the parallel combination (Zin) is determined, the process 1000 proceeds to 1014 and the system determines a value representative of the leakage of the earbud (Zleak). For instance, the impedance of the leak (Zleak) may be determines as follows:

$$Zleak = (NE - NEOT) * \frac{Zin}{NEOT}$$

where NE is representative of the noise energy difference between the exterior and in-ear microphones.

In some cases, the noise leakage value determined may be used to quantify the quality of the fit of the earbud to the listener, suggest adjustments to the type of bud used by the listener or currently inserted into the ear, and adjusting parameters (such as the noise cancellation settings) to compensate for the leakage at the eardrum.

Figure 11:
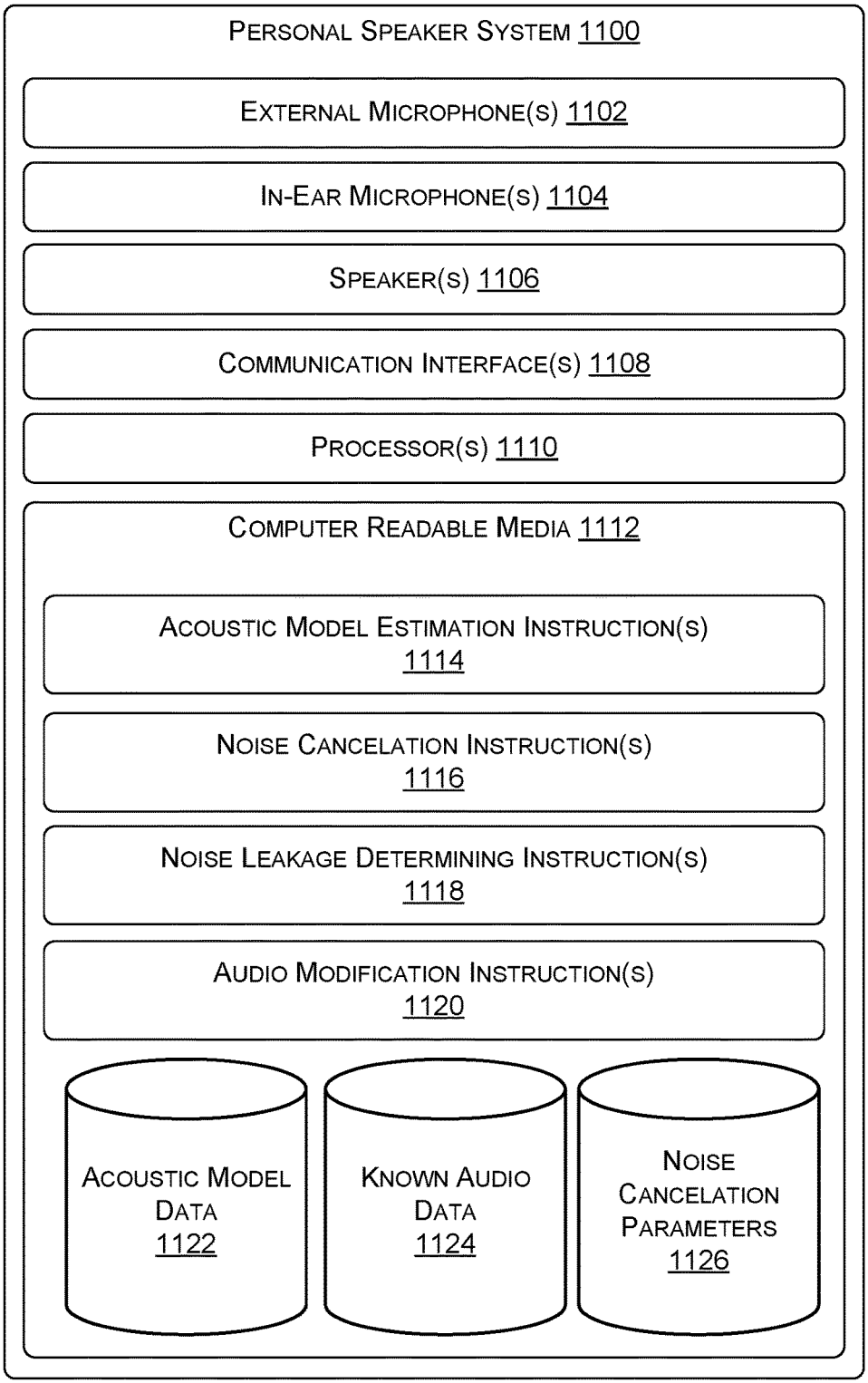
FIG. 11 illustrates an example architecture of a personal speaker system of FIGS. 1-10 according to some implementations.

FIG. 11 illustrates an example architecture of a personal speaker system 1100 of FIGS. 1-10 according to some implementations. As discussed above, the personal speaker system 1100 may be implementations to measure and map an individual's ear canal. In some cases, the measurements may be used to allow a personal speaker system 1100 to modify an output audio signal to compensate for compression or changes to the ear canal caused by the use of the speaker system 1100. For example, when using the personal speaker system 1100 the ear canal may be shortened when compared with a more natural listening experience. The changes to the ear canal and/or eardrum caused by use of the personal speaker system 1100 result in a human detectable change to the sound that the listener may perceive as unnatural. Therefore, the personal speaker system 1100 may be configured to map the listener's ear and to modify an audio signal to compensate for the compression. In addition, for example, the interaction between the personal speaker and the characteristics of the individual's ear canal and ear drum may cause a change in the frequency content of the recorded audio. This change may make the audio seem less natural to the user since the frequency content would be different from how the audio would sound if it were being consumed by the individual in free space without the personal listening device.

The personal speaker system 1100 may include one or more external microphones 1102 to capture audio of an environment surrounding the user (e.g., external noise) and one or more in-ear (or internal) microphones 1104 to capture audio within the ear canal. The microphones 1102 and/or 1104 may be implemented as a single omni-directional microphone, a calibrated microphone group, more than one calibrated microphone group, or one or more microphone arrays.

The personal speaker system 1100 also includes one or more speakers 1106 to output audio signals as sounds. For example, the speakers 1106 may output audio files received from various electronic devices, such as smart phones, tablets, computers, or other audio enabled devices.

The personal speaker system 1100 includes one or more communication interfaces 1108 to facilitate a communication with other devices, such as cloud based devices, an audio source, or other electronic devices via one or more networks. The communication interfaces 1108 may support both wired and wireless connection to various networks, such as cellular networks, radio, WiFi networks, short-range or near-field networks (e.g., Bluetooth®), infrared signals, local area networks, wide area networks, the Internet, and so forth. For example, the communication interfaces 1108 may cause the acoustic model of the listener's ear canal to be transmitted to another device, for instance, to use as part of machine learning or research.

The personal speaker system 1100 includes or accesses components such as at least one or more control logic circuits, central processing units, or processors 1110, and one or more computer-readable media 1112 to perform the function of the personal speaker system 1100. Additionally, each of the processors 1110 may itself comprise one or more processors or processing cores.

Depending on the configuration of the personal speaker system 1100, the computer-readable media 1112 may be an example of tangible non-transitory computer storage media and may include volatile and nonvolatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 1110.

Various instruction, information, data stores, and so forth may be stored within the computer-readable media 1112 and configured to execute on the processors 1110. For instance, the computer-readable media 1112 may store acoustic model estimation instructions 1114, noise cancellation instructions 1116, noise leakage determining instructions 1118, audio modification instructions 1120, as well as other modules. The computer-readable media 1112 may also store a data, such as acoustic model data 1122, known audio data 1124, and/or noise cancellation parameters 1126.

The acoustic model estimation instructions 1114 may be configured to generate acoustic model data 1122 using the in-ear microphones 1104 and the speaker 1106 of the personal speaker system 1100. In some cases, the acoustic model data 1122 may represent the state of the ear canal and ear drum with the personal speaker system 1100 in place on the listener's head. In some examples, the acoustic model estimation instructions 1114 may first determine a first thevinin equivalent pressure (Pth) and a first thevinin equivalent acoustic impedance (Zth) of the speaker 1106 using captured audio data related to known audio outputs.

The acoustic model estimation instructions 1114 may then model the distance between the position of the in-ear-microphone 1104 and the inner tip of the earbud as a first acoustic transmission line. For instance, the system may determine a first impedance ($Zo_1$), a first attenuation constant ($\alpha_1$), and a first phase constant ($\beta_1$) associated with the first acoustic transmission line. Next the acoustic model estimation instructions 1114 may model the abrupt diameter change from the outer tip of the earbud and the diameter of the ear canal as a lumped inductance (Ldis) dependent on the ratio of the bud radius and the ear canal radius.

The acoustic model estimation instructions 1114 may then model the length of the ear canal as a second acoustic transmission line. In this case, the acoustic model estimation instructions 1114 may determine a second characteristic impedance ($Zo_2$), a second attenuation constant ($\alpha_2$), and a second phase constant ($\beta_2$) and a length associated with the second acoustic transmission line. The second characteristic impedance, second attenuation constant and second phase constant may be determined by the estimated radius of the second acoustic transmission line and with the known speed of sound of air, density of air and thermoviscous properties of sound propagation in a cylinder. Next, the acoustic model estimation instructions 1114 may model the eardrum as a complex lumped acoustic impedance (Zdrum).

The noise cancellation instructions 1116 may be configure to cancel noise at various reference points within the ear canal, such as the inner tip, outer tip, or ear drum. For instance, the noise cancellation instructions 1116 may determine a pressure and impedance at the reference point and utilize the pressure and impedance at the reference point as noise cancellation parameters 1126.

The noise leakage determining instructions 1118 may be configured to determine noise leakage at the various refence points within the ear canal and to use the leakage values to determine proper placement of the personal speaker system 1100 on the head of the listener and/or proper fit of the personal speaker system 1100 or earbuds of the system 1100. For instance, the noise leakage determining instructions 1118 may utilize the acoustic model data 1122 to estimate noise energy at the reference points and utilize a comparison of the noise energy at the reference point and the noise energy external (e.g., noise energy captured by the external microphone 1102) to determine leakage.

The audio modification instructions 1120 may be configured to utilize the acoustic model data 1122 to determine audio adjustments for the listener. For example, the audio modification instructions 1120 may determine the difference in acoustic pressure at the eardrum that a listener would experience if the listener was listening to the content in free space without an earbud (the free space ear drum pressure) and the actual acoustic pressure at the eardrum using the personal speaker system (the actual pressure). The audio modification instructions may then adjust the audio so that the actual pressure at the eardrum is adjusted to be equivalent to the free space ear drum pressure, providing the user with a more natural listening experience.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A method comprising:

determining a pressure at an in-ear microphone of a personal speaker system;

determining an input impedance at the in-ear microphone;

determining the pressure and impedance at the output of a first acoustic line, the first acoustic line representative of a distance between the in-ear microphone and an inner tip of an earbud of the personal speaker system;

determine a diameter change between a radius of an outer tip of the earbud and a radius of an ear canal of a listener;

determining the pressure and impedance at the larger radius of the diameter change;

determining characteristics of a second acoustic line, the second acoustic line representative of a distance between the outer tip of the earbud and an eardrum of the listener;

determining a complex lumped acoustic impedance representative of the eardrum; and determining the pressure at the eardrum.

2. The method as recited in claim 1, wherein the characteristics of the first acoustic line include an impedance, an attenuation constant, and a phase constant.

3. The method as recited in claim 1, wherein the characteristics of the second acoustic line include an impedance, an attenuation constant, a phase constant and a length.

4. The method as recited in claim 1, further comprising:

determining a impedance at a point associated with an in-ear microphone based at least in part on the thevinin equivalent pressure of the speaker, the thevinin equivalent impedance of the speaker and the pressure at the in-ear microphone;

determining a impedance at the inner tip of the earbud based at least in part on the characteristics of the first acoustic line; determining a reflection coefficient at the inner tip of the earbud based at least in part on the thevinin equivalent impedance at the inner tip of the earbud;

determining a pressure at the inner tip of the earbud based at least in part on the reflection coefficient;

estimating noise energy at the inner tip of the earbud based at least in part on the pressure the inner tip of the earbud and the impedance at the inner tip of the earbud;

setting at least one parameter of a noise cancelation process based at least in part on the noise energy; and outputting anti-noise signal to cancel sound at the inner tip of the earbud, the anti-noise signal based on the least one parameter of the noise cancelation process.

5. The method as recited in claim 4, wherein estimating the noise energy includes:

determining the parallel combination of the impedance of an external microphone, the thevinin equivalent impedance of the speaker and characteristics of the acoustic transmission line between the speaker and the in-ear microphone; and determining the noise energy based at least in part on the parallel combination, the reflection coefficient at the inner tip, and the characteristics of the first acoustic line.

6. The method as recited in claim 1, further comprising:

determining a impedance at a point associated with an in-ear microphone based at least in part on the thevinin equivalent pressure of a speaker, the thevinin equivalent impedance of a speaker and the measured pressure an in-ear microphone;

determining a impedance at the inner tip of the earbud based at least in part on the characteristics of the first acoustic line; and determining a reflection coefficient at the inner tip of the earbud based at least in part on the impedance at the inner tip of the earbud;

determining a pressure at the inner tip of the earbud based at least in part on the reflection coefficient;

determining a impedance at the outer tip of the earbud based at least in part on the pressure at the pressure at the inner tip of the earbud;

determining a pressure at the outer tip of the earbud based at least in part on the impedance at the outer tip of the earbud;

estimating noise energy at the outer tip of the earbud based at least in part on the pressure the outer tip of the earbud and the impedance at the outer tip of the earbud;

setting at least one parameter of a noise cancelation process based at least in part on the noise energy; and outputting anti-noise signal to cancel sound at the outer tip of the earbud, the anti-noise signal based on the least one parameter of the noise cancelation process.

7. The method as recited in claim 6, wherein estimating the noise energy at the outer tip is based at least in part on noise energy determined at the inner tip.

8. The method as recited in claim 1, further comprising:

determining a impedance at a point associated with an in-ear microphone based at least in part on the thevinin equivalent pressure of a speaker, the thevinin equivalent impedance of a speaker and the measured pressure an in-ear microphone;

determining a impedance at the inner tip of the earbud based at least in part on the characteristics of the first acoustic line; and determining a reflection coefficient at the inner tip of the earbud based at least in part on the impedance at the inner tip of the earbud;

determining a pressure at the inner tip of the earbud based at least in part on the reflection coefficient;

determining a impedance at the outer tip of the earbud based at least in part on the pressure at the pressure at the inner tip of the earbud;

determining a pressure at the outer tip of the earbud based at least in part on the impedance at the outer tip of the earbud;

determining a length of an ear canal of the listener;

determining a impedance at the eardrum based at least in part on the length of the ear canal;

determining a reflection coefficient at the eardrum based at least in part on the impedance at the eardrum;

determining a pressure at the eardrum based at least in part on the reflection coefficient at the eardrum;

estimating noise energy at the eardrum based at least in part on the pressure the eardrum and the impedance at the eardrum;

setting at least one parameter of a noise cancelation process based at least in part on the noise energy; and outputting anti-noise signal to cancel sound at the eardrum, the anti-noise signal based on the least one parameter of the noise cancelation process.

9. The method as recited in claim 8, wherein estimating the noise energy at the eardrum is based at least in part on noise energy determined at the inner tip and noise energy determined at the outer tip.

10. The method as recited in claim 8, wherein the length of the ear canal is determined based at least in part on the half wavelength point of the ear canal.

11. A method comprising:

determining an impedance at a point associated with an in-ear microphone based at least in part on a thevinin equivalent pressure of the speaker, the thevinin equivalent impedance of the speaker, and the pressure measured at the in-ear associated with an acoustic model of an ear canal of a listener;

determining a impedance at the inner tip of the earbud based at least in part on the characteristics of the first acoustic line; and determining a reflection coefficient at the inner tip of the earbud based at least in part on the impedance at the inner tip of the earbud;

determining a pressure at the inner tip of the earbud based at least in part on the reflection coefficient;

determining a impedance at the outer tip of the earbud based at least in part on the pressure at the pressure at the inner tip of the earbud;

determining a pressure at the outer tip of the earbud based at least in part on the impedance at the outer tip of the earbud;

determining a length of an ear canal of the listener;

determining a impedance at the eardrum based at least in part on the length of the ear canal;

determining a reflection coefficient at the eardrum based at least in part on the impedance at the eardrum;

determining a pressure at the eardrum based at least in part on the reflection coefficient at the eardrum;

estimating noise energy at the eardrum based at least in part on the pressure the eardrum and the impedance at the eardrum;

setting at least one parameter of a noise cancelation process based at least in part on the noise energy; and outputting anti-noise signal to cancel sound at the eardrum, the anti-noise signal based on the least one parameter of the noise cancelation process.

12. The method as recited in claim 11, wherein estimating the noise energy at the eardrum is based at least in part on noise energy determined at the inner tip and noise energy determined at the outer tip.

13. The method as recited in claim 12, wherein the noise energy at the inner tip is based at least in part on a parallel combination of the leakage impedance from outside of the ear to inside of the ear and the thevinin equivalent impedance of the speaker.

14. A device comprising:

a speaker;

an in-ear microphone;

at least one processor;

a non-transitory computer readable media storing instructions which when executed by the at least one processor, cause the at least one processor to perform operations including:

determining a the pressure at an in-ear microphone of a personal speaker system;

determining a input impedance at the in-ear microphone;

determining the pressure and impedance at the end of a first acoustic line, the first acoustic line representative of a distance between the in-ear microphone and an inner tip of an earbud of the personal speaker system;

determine a diameter change between a radius of an outer tip of the earbud and a radius of an ear canal of a listener;

determining characteristics of a second acoustic line, the second acoustic line representative of a distance between the outer tip of the earbud and an eardrum of the listener;

determining a complex lumped acoustic impedance representative of the eardrum; and determining the pressure at the eardrum.

15. The device as recited in claim 14, wherein the non-transitory computer readable media stories additional instructions which when executed by the at least one processor, cause the at least one processor to perform operations including:

determining an impedance at a point associated with an in-ear microphone based at least in part on a thevinin equivalent pressure of the speaker, the thevinin equivalent impedance of the speaker, and the pressure measured at the in-ear associated with an acoustic model of an ear canal of a listener;

determining a impedance at the inner tip of the earbud based at least in part on the characteristics of the first acoustic line; determining a reflection coefficient at the inner tip of the earbud based at least in part on the impedance at the inner tip of the earbud;

determining a pressure at the inner tip of the earbud based at least in part on the reflection coefficient;

estimating noise energy at the inner tip of the earbud based at least in part on the pressure the inner tip of the earbud and the impedance at the inner tip of the earbud;

setting at least one parameter of a noise cancelation process based at least in part on the noise energy; and outputting anti-noise signal to cancel sound at the inner tip of the earbud, the anti-noise signal based on the least one parameter of the noise cancelation process.

16. The device as recited in claim 14, wherein the non-transitory computer readable media stories additional instructions which when executed by the at least one processor, cause the at least one processor to perform operations including:

determining an impedance at a point associated with an in-ear microphone based at least in part on a thevinin equivalent pressure of the speaker, the thevinin equivalent impedance of the speaker, and the pressure measured at the in-ear associated with an acoustic model of an ear canal of a listener;

determining a impedance at the inner tip of the earbud based at least in part on the characteristics of the first acoustic line; and determining a reflection coefficient at the inner tip of the earbud based at least in part on the impedance at the inner tip of the earbud;

determining a pressure at the inner tip of the earbud based at least in part on the reflection coefficient;

determining a impedance at the outer tip of the earbud based at least in part on the pressure at the thevinin equivalent pressure at the inner tip of the earbud;

determining a pressure at the outer tip of the earbud based at least in part on the impedance at the outer tip of the earbud;

estimating noise energy at the outer tip of the earbud based at least in part on the pressure the outer tip of the earbud and the impedance at the outer tip of the earbud;

setting at least one parameter of a noise cancelation process based at least in part on the noise energy; and outputting anti-noise signal to cancel sound at the outer tip of the earbud, the anti-noise signal based on the least one parameter of the noise cancelation process.

17. The device as recited in claim 14, wherein the non-transitory computer readable media stories additional instructions which when executed by the at least one processor, cause the at least one processor to perform operations including:

determining an impedance at a point associated with an in-ear microphone based at least in part on a thevinin equivalent pressure of the speaker, the thevinin equivalent impedance of the speaker, and the pressure measured at the in-ear associated with an acoustic model of an ear canal of a listener;

determining a impedance at the inner tip of the earbud based at least in part on the characteristics of the first acoustic line; and determining a reflection coefficient at the inner tip of the earbud based at least in part on the impedance at the inner tip of the earbud;

determining a pressure at the inner tip of the earbud based at least in part on the reflection coefficient;

determining a impedance at the outer tip of the earbud based at least in part on the pressure at the pressure at the inner tip of the earbud;

determining a pressure at the outer tip of the earbud based at least in part on the impedance at the outer tip of the earbud;

determining a length of an ear canal of the listener;

determining a impedance at the eardrum based at least in part on the length of the ear canal;

determining a reflection coefficient at the eardrum based at least in part on the impedance at the eardrum;

determining a pressure at the eardrum based at least in part on the reflection coefficient at the eardrum;

estimating noise energy at the eardrum based at least in part on the pressure the eardrum and the impedance at the eardrum;

setting at least one parameter of a noise cancelation process based at least in part on the noise energy; and outputting anti-noise signal to cancel sound at the eardrum, the anti-noise signal based on the least one parameter of the noise cancelation process.

18. The device as recited in claim 17, further comprising:

a communication interface; and wherein the non-transitory computer readable media stories additional instructions which when executed by the at least one processor, cause the at least one processor to perform operations including outputting the pressure between at the in-ear microphone, the impedance at the in-ear microphone, the characteristics of the first acoustic line, the characteristics of the second acoustic line, and the complex lumped acoustic impedance representative of the eardrum to a remote device as an acoustic model of the listeners ear.

19. The device as recited in claim 14, wherein the characteristics of the first acoustic line include a first impedance, a first attenuation constant, and a first phase constant and the characteristics of the second acoustic line include a second impedance, a second attenuation constant, and a second phase constant.

20. The device as recited in claim 14, further comprising:

outputting by the speaker known wideband audio;

capturing audio data at the in-ear microphone while the speaker outputs the known wideband audio; and wherein the characteristics of the first acoustic line, the characteristics of the second acoustic line, and the complex lumped acoustic impedance representative of the eardrum are determined based at least in part on the audio data.

* * * * *